United States Patent [19]

Ihrig et al.

[11] 4,091,822

[45] May 30, 1978

[54] ARTICLE FOR THE SELECTIVE REMOVAL OF HYDROGEN CYANIDE FROM TOBACCO SMOKE

[75] Inventors: Arthur Morton Ihrig; David Lynn Williams, both of Greensboro, N.C.

[73] Assignee: Loews Theatres, Inc., New York, N.Y.

[21] Appl. No.: 571,758

[22] Filed: Apr. 25, 1975

[51] Int. Cl.[2] ..... A24B 15/027; B01D 39/00

[52] U.S. Cl. ..... 131/9; 55/68; 131/10.9; 131/264

[58] Field of Search ..... 131/264, 265, 266, 267, 131/269, 10 R, 9, 10.9, 207, 262 A; 55/68, 97, 98, 99

[56] References Cited

U.S. PATENT DOCUMENTS

| | | | |
|---|---|---|---|
| 3,347,247 | 10/1967 | Lloyd | 131/266 |
| 3,550,600 | 3/1972 | Horsewell et al. | 131/269 X |
| 3,716,063 | 2/1973 | Litzinger | 131/267 |
| 3,724,469 | 4/1973 | Reynolds et al. | 131/266 |
| 4,022,223 | 5/1977 | Rainer et al. | 131/10.9 |

OTHER PUBLICATIONS

"Chelating Agents and Metal Chelates" by Dwyer & Mellor; Academic Press New York & London 1964.

*Primary Examiner*—Robert W. Michell
*Assistant Examiner*—V. Millin
*Attorney, Agent, or Firm*—Brumbaugh, Graves, Donohue & Raymond

[57] ABSTRACT

An improved filter for tobacco products such as cigarettes is described, providing for selective HCN absorption. The selective adsorbant is a complex formed from a polydentate amine and a metal ion selected from the group consisting of zinc, iron (II), copper and nickel. The complex may be improved in its effectiveness by further combination with a polyalkylene oxide which acts synergistically therewith. Illustrative materials are the zinc complex of ethylenediamine employing polyethylene oxide as a synergist.

30 Claims, No Drawings

ARTICLE FOR THE SELECTIVE REMOVAL OF HYDROGEN CYANIDE FROM TOBACCO SMOKE

This invention relates to improvements in filters for tobacco smoke.

In recent years, there has been substantial interest in filters for tobacco smoke, particularly for cigarette filters, and of increasing interest is the improvement of additives for such filters which are capable of selectively removing individual smoke constituents. One such smoke constituent with respect to which selective removal is generally considered desirable is hydrogen cyanide. A number of materials have been suggested for the selective adsorption of HCN from tobacco smoke.

In U.S. Pat. No. 3,403,689 to Sublett et al., the use of sodium phosphite, potassium phosphite, lithium phosphite, sodium carbonate, potassium carbonate and lithium carbonate for this purpose is described, and in U.S. Pat. No. 3,403,690 to Horsewell et al., substances such as zinc acetate, zinc acetylacetonate, zinc isobutyrate and zinc trimethylacetate are mentioned.

In a later patent to Horsewell, U.S. Pat. No. 3,340,879, the use of poly (alkyleneimines) having a molecular weight in the order of 500 or higher is claimed to reduce volatile acidic components in tobacco smoke, presumably because of the availability of reactive imine sites. In U.S. Pat. No. 3,550,600, Horsewell et al. further described the combination of such polyethyleneimines, as well as other basic substances such as triethanolamine, sodium acetate, sodium carbonate and borax, capable of keeping the filter material substantially alkaline, in combination with zinc acetate, previously described by them for hydrogen cyanide adsorption for the removal of HCN, as well as steam-volatile phenols.

Still additional disclosures of filter additives for the selective removal of phenols appears in U.S. Pat. No. 3,605,759 to Owens et al. The Owens patent surveys the then-known state of the art as to HCN adsorption and points out that water-soluble inorganic salts, such as the alkaline metal carbonates are known to remove HCN, and that mild bases such as sodium bicarbonate will remove a portion of the acidic components of smoke. Owens claims that filters treated with a combination of an alkaline metal bicarbonate with a polyoxyethylene material show a much greater affinity for HCN from tobacco smoke than when the bicarbonate additive is used alone. In U.S. Pat. No. 3,618,619, Keifer describes a filter tow made from fiber spun from a solution containing HCN absorbants such as ZnO, $Fe_2O_3$ and $Cu_2O$. The tow is then made active to absorb HCN by application of an agent such as triethylene glycol, triacetin, polyethylene glycol, diethyl citrate, etc. A later patent to Hammersmith, U.S. Pat. No. 3,802,441 further describes HCN adsorption with a mixture of zinc oxide and a (sodium or potassium) carbonate which is intimately dispersed in a plasticizer for cellulose acetate such as triethylene glycol diacetate and polyethylene glycol, and thereafter applied to the filter tow.

The present invention concerns an improved tobacco smoke filter for selectively removing hydrogen cyanide which contains a salt of a metal selected from the group consisting of zinc, copper, nickel and iron (II), chelated with a polydentate amine of relatively low molecular weight containing not more than about 10 —NH— or —$NH_2$— groupings which are capable of forming complex bonds with the metal ions. In the amine complexes of the present invention, the amine or imine nitrogen constitutes the principal bonding atom present in the molecular structure of the complex although hydroxy, carbonyl or ether oxygen groupings may also be present.

Within this class of new amine complexes found to be useful for cyanide adsorption from cigarrette smoke are complexes formed from the lower alkylenes diamines, triamines, tetramines and pentamines such as ethylenediamine, diethylenetriamine, triethylenetetramine and tetraethylenepentamine or other such amines as described by the general formula $NH_2$—(R—NH)$_x$—H, wherein R is ethylene and $x$ is from 1 to 10. The ethylene group may bear a lower alkyl side chain, i.e., alkyl of 1–5 carbon atoms. In addition, as noted above, other amino compounds may be useful. Of particular significance in this respect are amino compounds such as the simple amino acids, for example, $\beta$-aminopropionic acid and glycine.

As the metal compound suitable for use in the present invention, the water-soluble salts of zinc, copper, nickel and iron (II) may be used, such as zinc chloride, zinc acetate, zinc nitrate, zinc fluoride, zinc bromide, zinc oxalate, zinc phosphate, copper sulfate, nickel (II) chloride, copper (II) sulfate, and other similar compounds. In general, the inorganic compounds formed of these metals with physiologically innoculous anions are suitable.

Particularly preferred complexes in accordance with the present invention are those formed from ethylenediamine and diethylenetriamine and inorganic zinc and nickel compounds. The preferred inorganic complexes are known to have a different structural configuration as shown by x-ray analysis from zinc complexes such as zinc acetylacetonate described in Horsewell U.S. Pat. No. 3,403,690 for selective HCN adsorption. Where the zinc acetylacetonate complex is described in the literature as being a trigonal bi-pyramidal structure, the preferred complexes of the present invention have an octahedral structure. Copper in aqueous solution is 4-coordinated, forming square-planar complexes. The reason for this is connected with the Jahn-Teller effect.

It should also be noted that while it is believed that the iron (II) amine complex would be effective, such a complex tends to be unstable in the presence of oxygen and water, being oxidized to ferric oxide, a substance which does not complex with the amines. Accordingly, when the iron (II) complex is used, it should be under conditions which maintain its stability.

A number of amine complexes suitable for use in the present invention have been tested for HCN adsorption efficiency using simple screening techniques. The following is a partial list of the results of such screening test:

TABLE I

| Nature of Additive | Application | Quantity of Metal Ion/ filter sec. in mg. | Percent Removal of HCN |
|---|---|---|---|
| Nickel complex of sodium salt of $\beta$-aminopropionic acid | I | 9.25 | 60 |
| Nickel, diethylamine complex | I | 2.22 | 48 |
| bis (ethylenediamine) copper (II) sulphate | I | 3.05 | 45 |
| tris (ethylenediamine) zinc (II) chloride | I | 2.39 | 100 |
| tetraaminecopper (II) sulphate | I | 3.05 | 13 |
| tris (ethylenediamine) zinc (II) chloride | I | 4.79 | 73 |
| tris (ethylenediamine) | | | |

TABLE I-continued

| Nature of Additive | Application | Quantity of Metal Ion/filter sec. in mg. | Percent Removal of HCN |
|---|---|---|---|
| zinc (II) chloride tris (ethylenediamine) | I | 2.40 | 55 |
| zinc (II) chloride tris (ethylenediamine) | I | 1.20 | 52 |
| zinc (II) chloride | I | 0.60 | 34 |
| zinc complex of tetraethylenepentamine | I | 1.20 | 73 |
| zinc complex of β-aminopropionic acid | I | 1.20 | 39 |
| tris (ethylenediamine) nickel (II) chloride | I | 1.22 | 61 |
| tris (glycine) zinc (II) chloride | I | 1.20 | 38 |
| tris (glycine) nickel (II) chloride | I | 0.74 | 47 |
| copper complex of triethylenetetramine | I | 0.64 | 59 |
| nickel complex of triethylenetetramine | I | 0.61 | 58 |
| nickel complex of triethylenetetramine | C | 9.0 | 62 |
| tris (ethylenediamine) zinc (II) chloride | C | 12.2 | 76 |
| bis (ethylenediamine) copper (II) sulphate | C | 9.1 | 62 |
| bis (ethylenediamine) copper (II) sulphate | C | 6.4 | 64 |
| tris (ethylenediamine) nickel (II) chloride | C | 6.3 | 50 |
| tris (ethylenediamine) zinc (II) chloride | C | 12.2 | 85 |

I - Aqueous solution of filter additive injected on the filter with a syringe
C - Cavity filter There appears to be a correlation between the stability of the complex and its ability to remove hydrogen cyanide. A possible explanation for the above correlation is the solubility of cellulose acetate in a wide range of organic compounds including these polydentate amines. In a strong complex, the amines will remain bonded to the metal and there should be very little tendency for the amine to migrate into the filter fiber where it would be less effective in removing hydrogen cyanide. Table II is a list of equilibrium constants for various complexes.

TABLE II

| Metal Ion | Stability Constants for Various Metal Complexes* Ethylenediamine | Triethylenetetramine | Tetraethylenepentamine | Acetylacetone |
|---|---|---|---|---|
| Cu | 21.3 | 20.1 | 22.9 | |
| Ni | 20.1 | 14.1 | 17.8 | 10.4 |
| Zn | 14.2 | 11.9 | 15.4 | 8.8 |

*Each constant is in its logarithmic form.

The stability constant of the zinc acetylacetone complex is over 1,000 times less than the corresponding amine complexes. It is estimated from the foregoing that the preferred compounds of the present invention should have a stability constant of at least about $10^{11}$.

A modification of the present invention concerns the further discovery that the complexes here found to be suitable for selective HCN adsorption interreact synergistically with polyalkylene glycols to provide even more effective adsorption for HCN, notwithstanding the fact that the polyoxyalkylene compounds used as synergists are substantially ineffective by themselves as selective adsorbants. This permits a substantially reduced level of metal complex required to produce the desired result. The polyoxyalkylene compounds suitable for use as synergists in accordance with the present invention are of the general formula:

$$R(XOH)_a$$

$$RN_b(XOH)_{2b}$$

wherein R is a saturated hydrocarbon radical containing from 2 to 6 carbon atoms, X is a polymeric chain having the formula $—[OR']_z—$, R' being an alkylene radical having from 2 to 3 carbon atoms, and $a$ is 2 or 3, and $b$ is a small whole number from 1 to 2. Evaluation of the polyalkylene compounds as synergists has most generally involved the widely-available polyalkylene oxides of the formula $HO(C_2H_4O)_xH$ known as Carbowaxes. These fall within the above generic formula R(XOH) wherein R is an ethylene grouping and X is $—O—C_2H_4—$.

The foregoing compounds should contain from 10 to 37% ether oxygen, based on the weight of the compound, the preferred materials containing from 16 to 37% ether oxygen. By "ether oxygen" is meant the group —O— which occurs between successive alkylene groups in the "X" chain.

In selecting a suitable molecular weight, the vapor pressure of the synergist compounds should be sufficiently low that it will remain in the filter during storage and will not volatilize during the smoking of the cigarette. The vapor pressure of the synergist compounds should be below 40 mm. Hg at 25° C., however, the preferred range is below 1 mm Hg at 25° C. A further limitation on the molecular weight of the polymeric compound is that the compound should be soluble in the plasticizer for the filter fiber base. Best results should be obtained for polyalkylene oxides having a molecular weight between about 300 and 1,000, especially those which are liquid at room temperature.

Particularly preferred compounds are those derived from ethylene oxide.

Several typical compounds are illustrated by, but not limited to the materials set forth in Table III.

TABLE III

| Formula of Polymeric Condensate | Approx. Mol. Wt. | Monomeric Units | Available From | Trade Name | Manufacturer's Trade Bulletin |
|---|---|---|---|---|---|
| $HO(C_2H_4O)_xH$ | From 300 to 1000 | Ethylene oxide | | Carbowax | |
| $C_3H_5[(OC_3H_6)_xOH]_3$ | 3000 | Glycerol, propylene oxide | Union Carbide Chemicals Co. | Niax L G 56 | "Union Carbide Chemical Co. Technical Bulletin Niax Polyethers" (1961) |
| $C_3H_5[(OC_3H_6)_xOH]_3$ | 1000 | " | " | Niax L G 168 | " |

TABLE III-continued

| Formula of Polymeric Condensate | Approx. Mol. Wt. | Monomeric Units | Available From | Trade Name | Manufacturer's Trade Bulletin |
|---|---|---|---|---|---|
| $C_6H_{11}[(OC_3H_6)_xOH]_3$ | 5000 | Hexanetriol, propylene oxide | " | Niax LH T 34 | " |
| $C_6H_{11}(OC_3H_6)_xOH$ | 4100 | Trimethanol, propane, propylene oxide | Wyandotte Chemicals Corp. | Pluracol 4040 | "Wyandotte Chemicals Technical Bulletin Pluracol T P Triols" (1958) |

It is believed that these same polyalkylene compounds suitable as synergists for use with the amino complexes of the present invention also exhibit synergistic effects with respect to the organic zinc complexes described in the Horsewell U.S. Pat. No. 3,403,690, such as zinc acetylacetonate.

To prepare synergistic combinations of a zinc complex with a polyalkylene substance such as described above, the polyether is applied in conjunction with the inorganic complex onto the filter substrate. Appropriate steps are taken to assure thorough dispersion and comingling of the complex with the polyether synergist. Where those complexes are adequately soluble in the polyether or in a mutual solvent therefor such as water, preparation of an appropriate simple solution is convenient. However, if the complex or the polyether is insoluble or only partially soluble, it will be obvious to those skilled in the art that the suspension which results should be thoroughly homogenized before application to the filter substrate.

Thus, in preparing filters in accordance with the present invention, the inorganic complex is applied in a straightforward fashion, such as by dissolving it in water and applying it to the fibrous filter material by spraying a coating. Alternatively, other impregnating techniques may be used such as immersion, roll coating, syringe injection or other methods adaptable to commercial filter rod makers used to apply a liquid plasticizer to a filter tow.

In the absence of synergists, the filter is treated with a sufficient amount of the metal complex to provide effective HCN removal, usually from 1 to 8 mgs of metal ion per filter section for a typical cigarette. However, it has been found that one of the principal advantages of a polyether synergist according to the present invention is that the amount of metal complex required for effective HCN adsorption is reduced by from 50 to 75%. Thus, when used in combination with a polyether, it has been found most suitable to provide from 2 to 10 parts of the polyether for each part of metal ion and to apply from 0.2 to 4 mg of metal ion concentration per filter section for a typical cigarette. The most favorable concentration in combination with the synergist appears to be between 0.5 and 2 mg of metal ion.

Alternatively, filters can be prepared from the dry complex applied to the tow by any of the many available techniques developed for the application of solvents to cellulose filters. In another technique, the inorganic complex can be added at levels between about 0.5 to 10% by weight of an inert support such as pumice, Fuller's earth, powdered cellulose and the like, and 50 to 150 mg of this activated material pressed in a multi-section cavity-type filter or applied as a solid to fibrous filter materials.

This invention will now be described in further detail with reference to specific embodiments thereof. Hydrogen cyanide analyses were run on a Technicon Auto Analyzer using the procedures of Collins et al., *Tobacco Sci.*, 14, 12 (1970). The HCN values are the average of four determinations. Vapor phase analyses were performed by standard gas chromatography techniques.

EXAMPLE 1

Tris (ethylenediamine) zinc (II) chloride is prepared by adding 788 ml of ethylenediamine (3.0 molar equivalents) to an aqueous solution containing 533 gms of zinc chloride in 1800 ml of water. The plasticizing solution is Estrabond E (a mixture of 55 percent triacetin and 45 percent ethylene glycol 400). Filter rods (120 mm) were made at "standard" pressure drop and weight. The plasticizer solution and zinc complex solutions were applied separately to the tow with wick applicators. For a 20 mm filter section, an overall weight increase of 11.4 percent was observed with a zinc ion and polyethylene glycol concentration of 0.73 mg and 2.66 mg respectively for a 20 mm filter section. 85 mm cigarettes were then prepared containing a 20 mm filter section. Analyses for hydrogen cyanide and various other constituents are given in Table IV.

EXAMPLE 2

Filter rods were prepared using the same procedure as in Example 1 except that the delivery rate of the plasticizer and zinc complex solution was increased to afford a weight increase of 19.3 percent. Zinc analyses performed on a portion of the rods indicated 1.47 mg per 20 mm filter section. The polyethylene glycol level was estimated to be 5.3 mg. Analyses for hydrogen cyanide and various other constituents are given in Table IV.

EXAMPLE 3

Filter rods were prepared in accordance to the procedure outlined in Example 1, except that water was applied to the filter in place of the zinc complex. A 11.5 percent increase in rod weight was observed with the application of 2.75 mg of polyethylene glycol. Analyses for hydrogen cyanide and various other constituents are given in Table IV.

There is little or no adverse effect upon the taste of the smoke filtered with filters prepared by the procedures described in the above examples. Vapor phase results shown in Table IV indicate that HCN is selectively removed relative to other organic compounds.

TABLE IV

| | Example I | Example II | Example III | Commercial Control |
|---|---|---|---|---|
| Percent Removal Hydrogen Cyanide | 83% | 97% | 3% | * |
| Zinc ion conc. per 20 mm filter section | 0.73 mg | 1.47 mg | 0 | 0 |
| isoprene | 266 μgm | 350 μgm | 243 | 330 μgm |
| acetaldehyde | 685 | 840 | 748 | 903 |
| acetone | 509 | 651 | 442 | 517 |
| acrolein | 78 | 90 | 83 | 91 |
| benzene | 88 | 100 | 78 | 89 |
| acetonitrile | 242 | 264 | 282 | 259 |
| toluene | 135 | 154 | 128 | 135 |
| nicotine | 1.13 mg | 1.06 mg | 1.14 mg | 1.07 mg |
| total particular matter | 16.5 mg | 15.4 mg | 16.0 mg | 15.8 mg. |

* % HCN removal is stated at % removal relative to the HCN found in the commercial control. For this series the control showed 200 mg of HCN.

Additional examples of the synergistic effects of a polyalkylene glycol are indicated in the following further tests:

TABLE V

| Nature of Additive | Application | Quantity of Metal Ion/ filter sec. in mg. | Percent Removal of HCN |
|---|---|---|---|
| tris (ethylenediamine) nickel (II) chloride with polyethylene glycol | I | 0.30 | 68 |
| tris (ethylenediamine) zinc (II) chloride with polyethylene glycol | I | 0.60 | 79 |
| bis (ethylenediamine) copper (II) sulphate with polyethylene glycol | I | 0.32 | 55 |
| tris (acetylacetonate) iron (III) sulphate with polyethylene glycol | I | 0.17 | 10 |
| tris (salicylaldehyde) iron (III) sulphate with polyethylene glycol | I | 0.17 | 23 |
| tris (ethylenediamine) nickel (II) chloride with polyethylene glycol | R | 0.30 | 56 |
| tris (ethylenediamine) nickel (II) chloride with polyethylene glycol | R | 0.16 | 49 |
| tris (ethylenediamine) nickel (II) chloride with polyethylene glycol | R | 0.10 | 42 |

I - Aqueous solution of filter additive injected on the filter with a syringe.
R - Rodmaker was used to produce the filter rods and apply the additive.

The following series of experiments illustrate the difference in reactivity between copper, zinc and nickel complexes:

EXAMPLE 4

Ten grams of polyethylene 750 is added to a 30.1 ml solution containing tris (ethylenediamine) nickel (II) chloride prepared from 1 gm of $NiCl_2.6H_2O$ and 1.2 ml of ethylenediamine. 50 μl of this solution was injected into a 20 mm filter section of a commercial 85 mm cigarette to give a concentration of 0.309 mg of $Ni^{2+}$ion and 12.5 mg of polyethylene glycol-750. Hydrogen cyanide analysis indicated 68 percent removal.

EXAMPLE 5

Ten grams of polyethylene glycol-750 is added to a 30.0 ml solution containing tris (ethylenediamine) zinc (II) chloride prepared from 1 gm $ZnCl_2$ and 1.35 ml of ethylenediamine. 50 ul of the above solution was injected into a 20 mm filter section of a commercial 85 mm cigarette to give 0.59 mg of zinc and 12.5 mg of polyethylene glycol-750. Hydrogen cyanide analysis indicated 79 percent removal.

EXAMPLE 6

Ten grams of polyethylene glycol-750 is added to a 30.0 ml solution of bis (ethylenediamine) copper (II) sulphate containing 1.0 gm of $CuSO_4.5H_2O$ complexed with 1.00 ml of ethylenediamine. 50 μl of the solution was injected into a 20 mm filter section of a commercial 85 mm cigarette to give filters containing 0.331 mg of $Cu^{2+}$ion and 12.5 mg of polyethylene glycol-750. Hydrogen cyanide analysis indicated 55 percent removal.

It will be understood that this disclosure is intended to cover any of the various complexes which exist in equilibrium when solutions of metal ions (M) are permitted to react with an organic ligand (am). There will be *n* such equilibria where n represents the maximum coordination number of the metal ion (M) for the ligand (am). For example, $Zn^{2+}$forms ethylenediamine zinc (II), bix (ethylenediamine) zinc (II) and tris (ethylenediamine) zinc (II) ions depending on the concentration of ethylenediamine and its equilibrium constants. For a general inorganic complex, these stepwise equilibria can be represented by the following equations and equilibrium expressions:

$$M + am \rightleftharpoons M(am) \qquad K_1 = \frac{[M(am)]}{[M]\,[am]}$$

$$M(am) + am \rightleftharpoons M(am)_2 \qquad K_2 = \frac{[M(am)_2]}{[M(am)]\,[am]}$$

$$M(am)_n + am \rightleftharpoons M(am)_n \qquad K = \frac{[M(am)_n]}{[M(am)_{n-1}]\,[am]}$$

The overall equilibrium Bn for these *n* independent equilibria is $Bn = K_1K_2K_3 \ldots Kn$ where $K_1$, $K_2$, $K_3$, are the individual equilibrium constants.

We claim:

1. An improved tobacco smoke filter comprising a complex formed by combining a water-soluble salt of a metal selected from the group consisting of zinc, copper, nickel and iron (II) with a polydentate amine of the general formula $NH_2—(R—NH)_x—H$ where R is methylene or ethylene and *x* is an integer from 1 to 10, said complex having an octahedral crystallographic structure, and said complex being dispersed on a carrier therefor effective to provide an intimate exposure of said complex to a tobacco smoke stream containing HCN drawn through said filter, the amount of said complex being sufficient to remove selectively at least a portion of HCN from said tobacco smoke stream.

2. A tobacco smoke filter according to claim 1 wherein said complex is formed from a water-soluble zinc salt in combination with a polydentate amine selected from the group consisting of ethylenediamine, diethylenetriamine, triethylenetetramine and tetraethylenepentamine.

3. A tobacco smoke filter according to claim 1 wherein said complex is formed from a water-soluble copper salt in combination with a polydentate amine selected from the group consisting of ethylenediamine, diethylenetriamine, triethylenetetramine and tetraethylenepentamine.

4. A tobacco smoke filter according to claim 1 wherein said complex is formed from a water-soluble nickel salt in combination with a polydentate amine selected from the group consisting of ethylenediamine, diethylenetriamine, triethylenetetramine and tetraethylenepentamine.

5. A tobacco smoke filter according to claim 1 wherein said complex is formed from a water-soluble iron (II) salt in combination with a polydentate amine selected from the group consisting of ethylenediamine, diethylenetriamine, triethylenetetramine and tetraethylenepentamine.

6. In a filter tip cigarette having in combination an elongated cylindrical plug of shredded tobacco joined at one end thereof with a filter element having a fibrous base material, the improvement comprising the combination with the fibrous base material of a complex formed by combining a water-soluble salt of a metal selected from the group consisting of zinc, copper, nickel and iron (II), and an amine of the general formula $NH_2(R—NH)_x—H$ wherein R is methylene or ethylene and $x$ is an integer from 1 to 10, said comlex having an octahedral crystallographic structure, and said complex being present in an amount between about 1 and 8 mgs of metal ion in said filter effective to absorb selectively at least a portion of any HCN produced upon combustion of said shredded tobacco.

7. An improved filter tip cigarette according to claim 6 wherein said complex is formed from the combination of a water-soluble zinc compound and a polydentate amine selected from the group consisting of ethylenediamine, diethylenetriamine, triethylenetetramine and tetraethylenepentamine.

8. An improved filter tip cigarette according to claim 6 wherein said complex is formed from the combination of a water-soluble copper compound and a polydentate amine selected from the group consisting of ethylenediamine, diethylenetriamine, triethylenetetramine and tetraethylenepentamine.

9. An improved filter tip cigarette according to claim 6 wherein said complex is formed from the combination of a water-soluble nickel compound and a polydentate amine selected from the group consisting of ethylenediamine, diethylenetriamine, triethylenetetramine and tetraethylenepentamine.

10. An improved filter tip cigarette according to claim 8 wherein said complex is formed from the combination of a water-soluble iron compound and a polydentate amine selected from the group consisting of ethylenediamine, diethylenetriamine, triethylenetetramine and tetraethylenepentamine.

11. An improved tobacco smoke filter comprising the combination of (i) a complex formed from a metal ion selected from the group consisting of zinc, copper, nickel and iron with acetylacetone or polydentate amine having not more than about 10 nitrogen atoms, and (ii) a synergist therefor which is a polyoxyalkylene of the general formula $$R'(XOH)_a$$

or $$R'N_b(XOH)_{2b}$$

wherein R' is a saturated hydrocarbon radical containing from 2 to 6 carbon atoms, and X is a polymeric chain of the formula $$—[OR^2]_x—$$

$R^2$ being an alkylene radical having from 2 to 3 carbon atoms, $a$ being 2 to 3 and $b$ being 1 or 2 in said filter, said complex and said polyoxyalkylene compound being dispersed on a carrier therefor which is effective to provide an intimate exposure of said complex and said polyoxyalkylene to tobacco smoke containing HCN drawn through said filter; the amount of said polyoxyalkylene compound being between about 2 and about 10 parts for each part of said metal ion; and the amount of said metal ion present in the said filter being effective to remove at least a portion of the HCN contained in said tobacco smoke.

12. An improved tobacco smoke filter according to claim 11 wherein said polyoxyalkylene compound has a molecular weight between about 300 and 1,000 and is a liquid at room temperature.

13. An improved tobacco smoke filter according to claim 12 wherein said complex is formed from a polydentate amine of the formula $$NH_2(R—NH)_x—H$$

wherein R is methylene or ethylene and $x$ is an integer from 1 to 10; and said metal is a water-soluble salt of zinc, copper or nickel.

14. An improved tobacco smoke filter according to claim 13 wherein said complex has an octahedral crystalographic structure.

15. A tobacco smoke filter according to claim 13 wherein said complex is formed from a water-soluble salt of zinc in combination with the polydentate amine selected from the group consisting of ethylenediamine, diethylenetriamine, triethylenetetramine and tetraethylenepentamine.

16. A tobacco smoke filter according to claim 13 wherein said complex is formed from a water-soluble salt of copper in combination with the polydentate amine selected from the group consisting of ethylenediamine, diethylenetriamine, triethylenetetramine and tetraethylenepentamine.

17. A tobacco smoke filter according to claim 13 wherein said complex is formed from a water-soluble salt of nickel in combination with the polydentate amine selected from the group consisting of ethylenediamine, diethylenetriamine, triethylenetetramine and tetraethylenepentamine.

18. A tobacco smoke filter according to claim 13 wherein said complex is formed from a water-soluble salt of iron (II) in combination with the polydentate amine selected from the group consisting of ethylenediamine, diethylenetriamine, triethylenetetramine and tetraethylenepentamine.

19. In a filter tip cigarette having in combination an elongated cylindrical plug of shredded tobacco joined at one end thereof with a filter element having a fibrous base material, the improvement comprising the combination with said firbous material of (i) a complex formed from a metal ion selected from the group consisting of zinc, copper, nickel and iron with acetylacetone or a polydentate amine having not more than about 10 nitrogen atoms, and (ii) a synergist therefor which is a polyoxyalkylene of the general formula $$R'(XOH)_a$$

or $RN_b(XOH)_{2b}$ wherein R′ is a saturated hydrocarbon radical containing from 2 to 6 carbon atoms, and X is a polymeric chain of the formula $$-[OR^2]_z-$$

$R^2$ being an alkylene radical having from 2 to 3 carbon atoms, *a* being 2 or 3 and *b* being 1 or 2, in said filter the amount of said polyoxyalkylene compound being present in an amount between 2 and 10 parts for each part of said metal ion; and the amount of said metal ion being between about 0.2 and 4 mg, sufficient to remove at least a portion of any HCN produced upon combustion of said tobacco.

20. An improved filter tip cigarette according to claim 19 wherein said polyoxyalkylene compound has a molecular weight between about 300 and 1,000 and is a liquid at room temperature.

21. An improved filter tip cigarette according to claim 20 wherein said complex is formed from a water-soluble salt of a metal selected from the froup consisting of zinc, copper, nickel and iron (II) and an amine of the general formula $$NH_2—(R—NH)_x—H$$

wherein R is a methylene or ethylene and *x* is an integer from 1 to 10, said complex being present in an amount between about 0.2 and 4 mgs of metal ion in said filter.

22. An improved filter tip cigarette according to claim 21 wherein said complex has an octahedral crystalographic structure.

23. An improved filter tip cigarette according to claim 21 wherein said complex is formed from the combination of a water-soluble zinc compound and a polydentate amine selected from the group consisting of ethylenediamine, diethylenetriamine, triethylenetetramine and tetraethylenepentamine.

24. An improved filter tip cigarette according to claim 21 wherein said complex is formed from the combination of a water-soluble copper compound and a polydentate amine selected from the group consisting of ethylenediamine, diethylenetriamine, triethylenetriamine and tetraethylenepentamine.

25. An improved filter tip cigarette according to claim 21 wherein said complex is formed from the combination of a water-soluble nickel compound and a polydentate amine selected from the group consisting of ethylenediamine, diethylenetriamine, triethylenetetramine and tetraethylenepentamine.

26. An improved filter tip cigarette according to claim 25 wherein said complex is formed from the combination of a water-soluble iron (II) compound and a polydentate amine selected from the group consisting of ethylenediamine, diethylenetriamine, triethylenetetramine and tetraethylenepentamine.

27. An improved tobacco smoke filter comprising a complex formed by combining a water-soluble salt of a metal selected from the group consisting of zinc, copper, nickel and iron (II) with a polydentate amine of the general formula $NH_2—(R—NH)_x—H$ where R is a methylene or ethylene and *x* is an integer from 1 to 10, said complex having a square planar crystallographic structure, and said complex being dispersed on a carrier therefor effective to provide an intimate exposure of said complex to a tobacco smoke stream containing HCN drawn through said filter, the amount of said complex being sufficient to remove selectively at least a portion of HCN from said tobacco smoke stream.

28. A tobacco smoke filter according to claim 27 wherein the metal is copper.

29. An improved filter tip cigarette according to claim 28 wherein the metal is copper.

30. In a filter tip cigarette having in combination an elongated cylindrical plug of shredded tobacco joined at one end thereof with a filter element having a fibrous base material, the improvement comprising the combination with the fibrous base material of a complex formed by combining a water-soluble salt of a metal selected from the group consisting of zinc, copper, nickel and iron (II), and an amine of the general formula $NH_2—(R—NH)_x—H$ wherein R is methylene or ethylene and *x* is an integer from 1 to 10, said complex having a square planar crystallographic structure, and said complex being present in an amount between about 1 and 8 mgs of metal ion in said filter effective to absorb selectively at least a portion of any HCN produced upon combustion of said shredded tobacco.

* * * * *

UNITED STATES PATENT OFFICE

CERTIFICATE OF CORRECTION

Patent No. 4,091,822 Dated May 30, 1978

Inventor(s) Arthur Morton Ihrig et al.

It is certified that error appears in the above-identified patent and that said Letters Patent are hereby corrected as shown below:

Col. 1, line 48, "Keifer" should be --Kiefer--
Col. 4, line 26, after "as" insert --the--
Col. 5, line 66, "of" should be --on--
Col. 8, line 36, "..." should be -- -- --
Col. 8, line 59, "claim 1" should read --claim 27--
Col. 9, line 18, "comlex" should read --complex--
Col. 9, line 32, "6" should read --30--
Col. 9, line 44, "claim 8" should read --claim 6--
Col. 10, line 58, "firbous" should read --fibrous--
Col. 12, lines 1 and 2, "triethylenetriamine" should read --triethylenetetramine--
Col. 12, line 10, "claim 25" should read --claim 21--

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*